United States Patent [19]

Cox

[11] Patent Number: 4,859,162

[45] Date of Patent: Aug. 22, 1989

[54] ROTARY VANE COMPRESSOR

[75] Inventor: Robert J. Cox, Sheboygan, Wis.

[73] Assignee: Thomas Industries, Inc., Sheboygan, Wis.

[21] Appl. No.: 240,371

[22] Filed: Aug. 29, 1988

Related U.S. Application Data

[63] Continuation of Ser. No. 943,960, Dec. 22, 1986, abandoned.

[51] Int. Cl.[4] ..... F04C 18/00; F04C 29/00

[52] U.S. Cl. ..... 418/152; 418/178; 418/179; 418/236

[58] Field of Search ..... 418/46, 47, 152, 156, 418/178, 179, 236–238, 478, 133, 136; 384/478

[56] References Cited

U.S. PATENT DOCUMENTS

| | | | |
|---|---|---|---|
| 1,635,271 | 7/1927 | Hapgood | 418/46 |
| 1,886,618 | 11/1932 | Anstice | 384/135 |
| 2,483,013 | 9/1949 | Kopprasch | 384/135 |
| 2,674,953 | 4/1954 | Conde | 418/152 |
| 3,130,673 | 4/1964 | Finstad | 418/152 |
| 3,532,399 | 10/1970 | Gray | 384/478 |
| 3,847,455 | 11/1974 | Vandermeulen | 384/478 |
| 4,192,558 | 3/1980 | Wade | 384/478 |
| 4,274,816 | 6/1981 | Kobayashi | 418/238 |
| 4,276,007 | 6/1981 | Sakamaki | 418/178 |
| 4,362,480 | 12/1982 | Suzuki | 418/152 |

FOREIGN PATENT DOCUMENTS

| | | | |
|---|---|---|---|
| 1276181 | 6/1972 | United Kingdom | 418/179 |

*Primary Examiner*—Leonard E. Smith

*Attorney, Agent, or Firm*—James G. Staples; David I. Roche

[57] ABSTRACT

A rotary vane compressor or vacuum pump having an extended service life in which the rotor housing is composed of cast iron, the rotor of either cast iron or powder metallurgy materials, and the associated adjacent surfaces which form the rotor chamber are coated with a material having the characteristics of plastic with respect to friction and abrasion resistance.

5 Claims, 2 Drawing Sheets

ROTARY VANE COMPRESSOR

This application is a continuation of application Ser. No. 943,960, filed Dec. 22, 1986 now abandoned.

FIELD OF THE INVENTION

This invention relates generally to rotary vane compressors and vacuum pumps, more particularly, to rotary vane compressors and vacuum pumps which are reliable in operation throughout an extremely long operating life and yet are comparable in cost and ease of manufacture to current compressors and pumps which do not have the long life characteristics of the present invention.

BACKGROUND OF THE INVENTION

For ease of understanding, the invention will be described in terms of its application as a compressor.

Rotary vane compressors of the type in which a rotor, which carries a plurality of extensible and retractable vanes, rotates in a housing about an axis which is radially displaced from the axis of the housing bore are well-known. These compressors have many uses and literally thousands are put into service each year. Because of competitive pressure it is desirable to lower the weight and the cost of manufacturing such compressors. One expedient is to fabricate some of the compressor components of die cast aluminum. This lowers the weight since the conventional compressors are made from cast iron. Various attempts have been made to develop such a compressor including, purely by way of example, the apparatus disclosed in U.S. Pat. No. 3,552,895 which is said to have run for approximately 1,000 hours with no signs of appreciable wear, from which it may be inferred that a significantly greater service use, such as a doubling or tripling of operating time, would result in appreciable wear and therefore termination of useful service life.

The rotary vane compressor of the present invention has run over 8,000 hours under conventional service conditions without evidence of approaching failure and continues to operate. This has been accomplished in a structure which is very cost competitive with conventional compressors of similar rated and actual capacity. These desirable results have been achieved by the judicious use of complementary materials, with each material being appropriately matched to its required function.

In a preferred embodiment of the invention the rotor housing is formed from cast iron and the rotor is formed from either cast iron or by powder metallurgy techniques since either variant will produce acceptable results in the intended environment. The parts which abut the ends of the rotor housing are preferably made from aluminum, with the surfaces of said parts which contact the rotor housing being preferably coated with a suitable plastic material. Such a construction has yielded the impressive campaign results described above.

Two further features contribute to the long life of the compressor of this invention.

As is well known, bearing failure of the rotor shaft is a significant problem in such compressors. A contributing factor to such bearing failure is the fact that, in operation, the air which flows past the mid-plate assembly and along the motorshaft and impinges on the bearing has carbon dust and other particles, some of which are abrasive in nature, entrained therein. These materials, when they come in contact with the shaft bearing, may actually be entrapped in the bearing which effects its operation and, also, the bearing tends to overheat. The air is hot and even though there is no entrapment of the particles in the bearing, both the bearing and its seal are detrimentally affected by the hot air flow. The cumulative effect of prolonged exposure of the bearing to the carbon dust and particle laden air results in bearing failure much earlier than would be the case if these materials were not present in the hot air which impinges directly on the bearing. Accordingly, the deleterious effect of such dust and particles and hot air, said means including a slinger located upstream in the air flow to the bearing. The slinger functions to direct a substantial portion of the dust and particles and hot air away from the bearing, said dust and particles being thereby diverted to a fluid flow path which substantially by-passes the bearing.

As is also well-known, the vanes tend to fail before the balance of the components reach the end of their useful life. A prime cause of failure is the shaving action which the trailing edge of each vane slot in the rotor exerts on its associated vane. This problem appears to be entirely eliminated in the present invention by rounding the peripheral edge of each trailing vane slot with the result that the shaving action is eliminated and vane life dramatically increased.

Accordingly a primary object of the invention is to provide a rotary vane compressor fabricated from conventional materials by conventional methods which has a useful life much greater than the useful life of conventional compressors formed from the same class of materials.

Another object is to provide a rotary vane compressor as above-described which does not require unusual manufacturing techniques or utilize special coatings, such as aluminum oxide coatings.

A further object is to provide a slinger especially adapted for a rotary vane compressor which functions as a baffle to divert a portion of the carbon dust and abrasive particles, which are entrained in the air flow path along the rotor shaft, away from the rotor shaft bearing.

Yet a further object is to provide a rotary vane compressor which includes a slinger which functions as a baffle to divert a portion of the carbon dust and abrasive particles, which are entrained in the air flow path along the rotor shaft, away from the rotor shaft bearing.

Another object is to provide a rotor for a rotary vane compressor which exerts no shaving effect on the individual vanes as they reciprocate in their associated slots in the rotor.

Yet another object is to provide a rotary vane compressor which includes a rotor having means for reducing the shaving of each vane by the rotor as each vane reciprocates in its associated slot.

Other objects and advantages of the invention will become apparent from the following description of a preferred embodiment.

DESCRIPTION OF THE DRAWINGS

The invention is illustrated more or less diagrammatically in the accompanying drawing wherein.

DESCRIPTION OF THE PREFERRED EMBODIMENT

Figure 1:
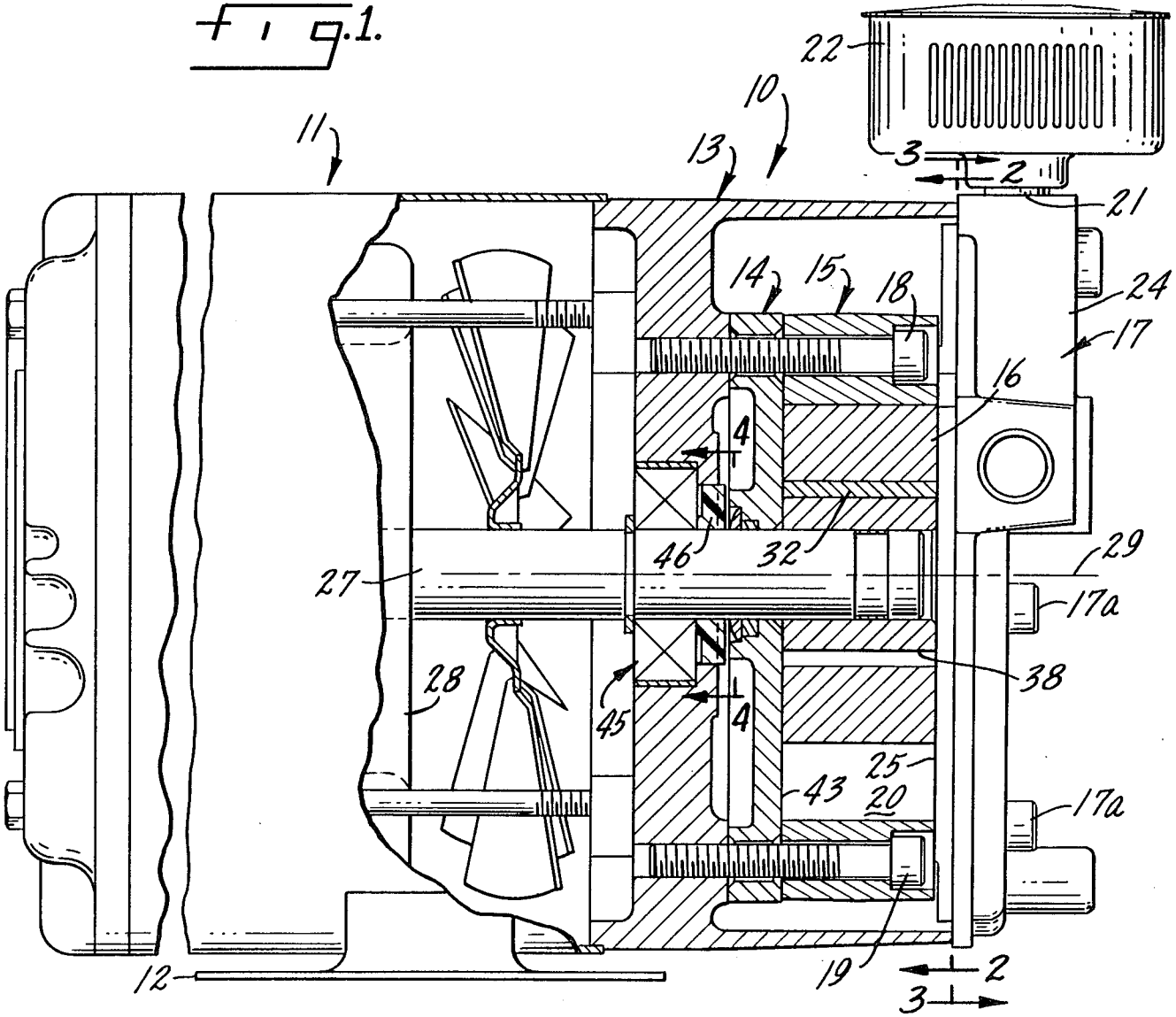
FIG. 1 is a elevation, with parts broken away and others shown in section for clarity, of the rotary vane compressor of this invention.
Figure 4:
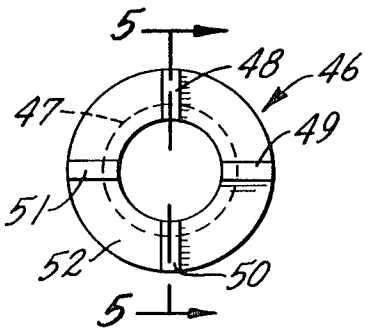
FIG. 4 is a view taken substantially along the 4—4 of FIG. 1.
Figure 5:
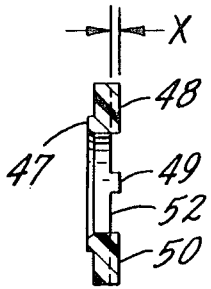
FIG. 5 is a view taken substantially along the 5—5 of FIG. 4.

Like reference numerals will be used to refer to like parts from Figure to Figure in the following description of the preferred embodiment of the invention.

The rotary vane compressor of this invention consists essentially of a rotor section, indicated generally at 10, and a motor section, indicated generally at 11, both sections being supported from any suitable support means, such as foot pad 12.

The rotor section consists of a middle support member, indicated generally at 13, a mid-plate assembly indicated generally at 14, a rotor housing 15, a rotor 16 and a head 17. The middle support member 13, mid-plate assembly 14 and rotor housing 15 are connected one to another by any suitable means, of which two machine screws are indicated at 18 and 19. The head 17 is connected to the balance of the assembly by similar connectors indicated at 17*a*.

Figure 3:
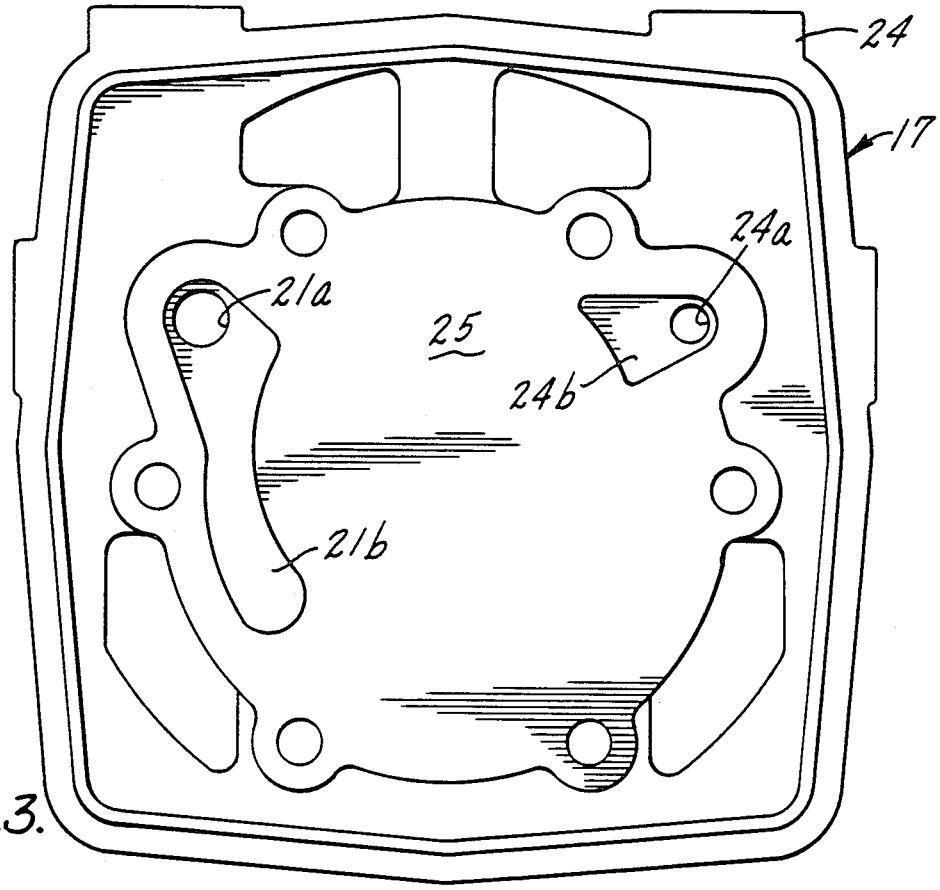
FIG. 3 is a view taken substantially along the line 3—3 of FIG. 1.

Mid-plate assembly 14 and head 17 function as closure means, in conjunction with the rotor housing 15, to form a rotor chamber 20. Each of mid-plate assembly 14 and head 17 has a suitable coating, hereinafter described, on their rotor chamber surfaces. Head 17 includes an inlet pipe 21 at the entrance to which a filter 22 is located. The inlet pipe 21 consists of a vertical passage, as viewed in FIG. 1, which, communicates with a horizontal passageway 21*a* which in turn opens into the face of head 17 and, accordingly, the rotor chamber 20. An outlet pipe is indicated at 24, the outlet pipe consisting essentially of a vertical passageway 24 which includes a right angle passageway 24*a* which opens into the face of head 17 to form a path for fluids exhausted from rotor chamber 20 after compression by the vane. The horizontal section 21*a* of the inlet pipe is illustrated best in FIG. 3 and the horizontal section 24*a* of the exhaust line is also shown best in FIG. 3. It will be noted that the horizontal section of port 21*a* communicates with an elongated depression 21*b* formed in the face 25 of head 17, and the horizontal section or outlet port 24*a* opens into a depression 24*b* which, as illustrated best in FIG. 3, is of a smaller planar area than depression 21*b*.

Figure 2:
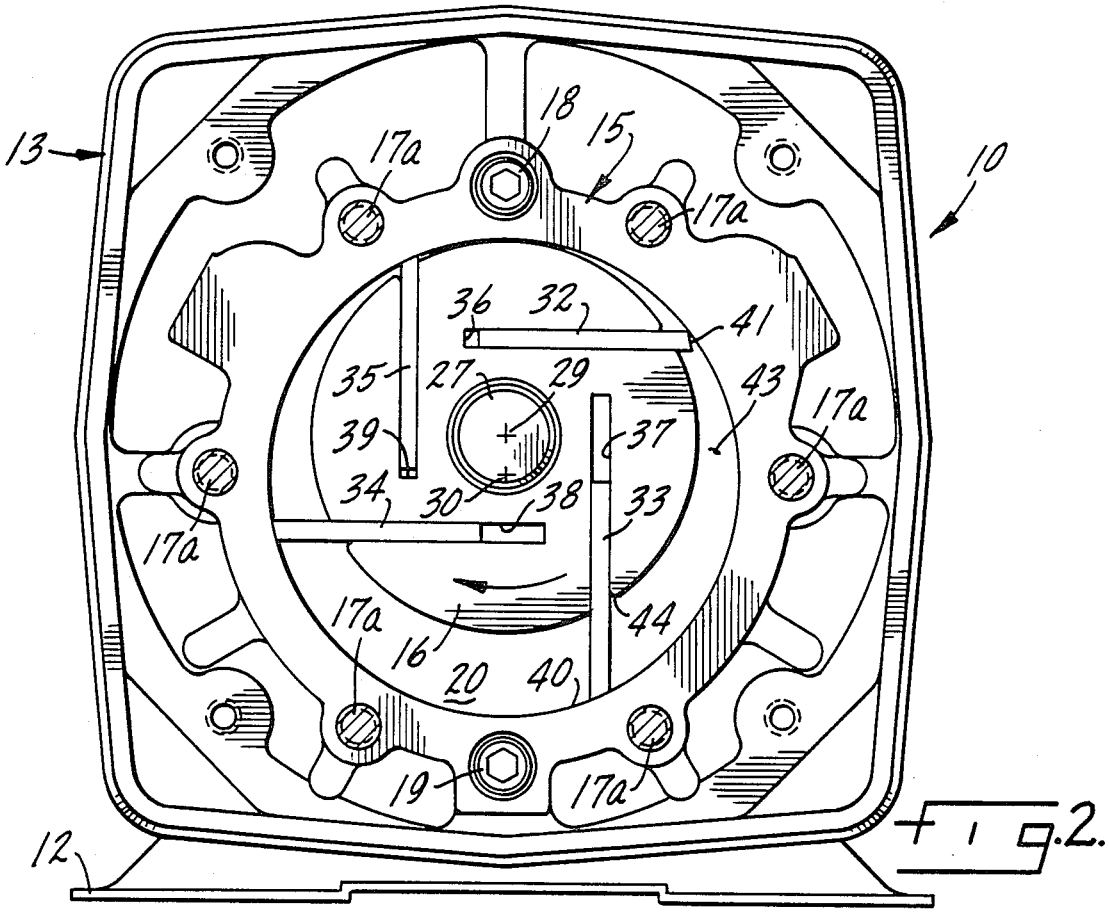
FIG. 2 is a view taken substantially along the line 2—2 of FIG. 1.

Rotor 16 is mounted for rotation on a motor output shaft 27 which in turn is powered by motor 28. As best seen in FIG. 2 the axis 29 around which rotor 16 rotates is offset from chamber axis 30 in a conventional manner. The plurality of vanes, in this instance four indicated at 32, 33, 34 and 35, are received in associated slots 36, 37, 38 and 39 in rotor 16. As will be well understood by those in the art, rotation of rotor 16 causes vanes 32–35 to move outwardly under the impetus of centrifugal force whereby the vanes 32–35 remain in continuous contact with the wall 40 of the rotor housing. It will be noted that, in this instance, the slots are uniformly, non-radially disposed with respect to the rotation axis 29 of rotor 16. It will be understood however that, if desired, the slots and vanes can be of a lesser length, and they may be radially disposed about axis 29. The vanes 32–35 are preferably formed from carbon and have an angled edge, indicated, as exemplary, at 41 so as to make close contact with wall 40 in the region of maximum angular difference between the working edge of the vanes and the rotor housing wall 40.

The composition of the materials which come in moving contact with one another is an important feature of the invention.

The rotor housing 15 is formed from cast iron. The rotor 16 is formed from either cast iron or by powder metallurgy techniques. The face of head 17 which forms one end of the rotor chamber is coated with a material having the characteristics of plastic with respect to friction and abrasion resistance. The plastic composition offered by the DuPont Corporation under identification No. 958-203 has been found quite suitable. The above commercial designation refers to single-coat, non-stick, self-lubricating, solvent-based finishes based on a special fluorocarbon resin and suitable modifiers. The resultant finish provides the desired hardness and abrasion resistance. The last digit in said designation merely refers to color. Preferably the thickness of the coating is on the order of 0.001". In similar fashion, the working face 43 of mid-plate assembly 14 is similarly coated with said plastic material to a thickness on the order of about 0.001".

As will be best seen in FIG. 2, the trailing edge of each slot in rotor 16 is rounded, as at 44, to substantially reduce the tendency of the rotor material, which is harder than the vane material, to bear against and, in effect, shave the vane as the vane reciprocates generally radially inwardly and outwardly as it revolves with the rotor.

As best seen in FIG. 1, the rotor 16 is mounted on the end of shaft 27 by any suitable means. The shaft 27 is journaled in bearing 45 which may be of conventional structure. A slinger is indicated at 46. The slinger includes a collar 47 on its downstream side which abuts the upstream side of bearing 45, the slinger being composed of any suitable type material such as nylon or other temperature resistant plastic or even metal. The collar 47 functions to provide an air gap between the bearing and the baffle which interrupts the heat flow from the air and thereby helps insulate the bearing. A plurality of ribs 48, 49, 50 and 51 are formed on the upstream side of the slinger, each rib projecting outwardly from the base surface 52 a distance X to thereby form a sweeper, or baffle, which can contact solid materials in the air stream passing through the assembly and sling them radially outwardly. The collar 47 spaces the main part of slinger 46 away from the bearing with an air gap to minimize the transfer of heat to the bearing. The slinger also functions as a baffle in that it prevents most of the air flow from reaching the bearing.

The use and operation of the invention is as follows.

As rotor 16 is rotated by shaft 27 from motor 28, vanes 32–35 alternately move out and then retract in a conventional manner as the rotor makes a 360° revolution, drawing air in through inlet pipe 21 and horizontal port 21*a* on the intake stroke and discharging air under pressure through outlet port 24*b*, outlet port 24*a* and outlet pipe 24 during the exhaust portion of a revolution. In this instance only a single inlet and a single outlet have been illustrated, but it will be understood that it is within the skill of those in the art to utilize a pair of inlets, each associated with an outlet, as is, for example exemplified by the structure in U.S. Pat. No. 3,552,895. Likewise, although the vanes have been illustrated in the preferred embodiment as being uniformly non-radially arranged with respect to the axis rotation 29, it will be understood that, if desired, the vanes may be radially disposed about axis 29. Irrespective of how the vanes are arranged, and the number and location of inlet and outlet ports however it is essential that the rotor housing, rotor and the head face 25 and mid-plate assembly face 43 be formed with the above-described materials. It will be understood that the thickness of the coating on head face 25 and mid-plate assembly face 43 is so thin that it is not practical to illustrate it in the drawing herein.

The vanes 32–35 do not contact a sharp edge formed at the periphery of their respective slots because each such terminus has been rounded, as at 44. The result is that no shaving action is applied to the vanes.

The bearing life is prolonged by the action of the slinger 46. The ribs 48–51 function to divert carbon dust and abrasive particles entrained in the air flowing through the system outwardly away from the bearing. As a result, build-up of dust and dirt and abrasion wear, with the ultimate looseness which ensues, is minimized, and bearing life is accordingly lengthened.

In one practical application of the invention a compressor as described herein was placed in conventional operation for testing purposes and, after a period of operation of over 8,000 hours, was examined for wear. A careful examination disclosed that the assembly was not approaching failure, and it appeared that a number of thousands of additional hours of useful service life could be obtained from the compressor before replacement would be required.

Alhough a preferred embodiment of the invention has been illustrated and described, it will be understood that modifications may be made within the spirit and scope of the invention. Accordingly it is intended that the scope of the invention be limited, not by the above description of a preferred embodiment, but solely by the scope of the hereafter appended claims when interpreted in light of the relevant prior art.

I claim:

1. In a rotary vane compressor, a rotor housing which forms, with closure means, a rotor chamber, rotor chamber outlet means and inlet means, a rotor in the rotor chamber carried by a shaft which is mounted for rotation about a fixed axis, a plurality of slots in the rotor which extend from end to end of the rotor, a vane adapted for reciprocating movement in each slot, said rotor being oriented with respect to the fixed wall of the rotor chamber and the inlet means and outlet means as to draw fluids through the inlet means and into an expanding and contracting pump space formed by the rotor chamber, the rotor, the closure means and the adjacent vanes, thereafter compressing the fluid and subsequently discharging the compressed fluid from the pumping space to the outlet means under pressure, said rotor housing being formed from cast iron, said rotor being formed from a material selected from the group consisting of cast iron and power metallurgy composition, at least that portion of said closure means which is located adjacent the rotor and vanes being coated with a material having the characteristics of plastic with respect to friction and abrasion resistance, said coating having a substantial thickness, said rotor shaft being journaled in a bearing which is located between the rotor and a power source, and further including means, located adjacent to and upstream of the bearing, for reducing the quantity of deleterious particles and hot air passing toward and through the bearing during normal operation, said means including a baffle surrounding the rotor shaft and located between the bearing and the rotor, said baffle having radial ribs for discharging a portion of said particles and hot air out of the fluid flow path which passes through the bearing.

2. The rotary vane compressor of claim 1 wherein the vanes are formed of carbon.

3. The rotary vane compressor of claim 1 wherein each slot and its associated van is positioned uniformly non-radially about the axis of rotation of the rotor.

4. The rotary vane compressor of claim 1 wherein the inlet means and the outlet means each comprise a single passage connecting the rotor chamber with the space external to the rotor chamber.

5. The rotary vane compressor of claim 1 wherein the trailing edge of each rotor slot is rounded.

* * * * *